US006033494A

United States Patent [19]

Hagura

[11] Patent Number: 6,033,494

[45] Date of Patent: Mar. 7, 2000

[54] METHOD OF BLACKENING A MAGNETIC SHIELD FOR USE IN A COLOR CRT

[75] Inventor: Satoshi Hagura, Shiga, Japan

[73] Assignee: NEC Corporation, Tokyo, Japan

[21] Appl. No.: 08/840,666

[22] Filed: Apr. 29, 1997

[30] Foreign Application Priority Data

Apr. 25, 1996 [JP] Japan ..... 8-103041

[51] Int. Cl.[7] ..... C23C 8/80

[52] U.S. Cl. ..... 148/277; 148/287; 148/604

[58] Field of Search ..... 148/277, 287, 148/604; 445/47; 313/402

[56] References Cited

U.S. PATENT DOCUMENTS 2,333,936 11/1943 Johnson ..... 148/287
3,122,459 2/1964 Hollis et al. ..... 148/287
4,859,251 8/1989 Hayami et al. ..... 148/286
5,094,920 3/1992 Shiozaki et al. ..... 148/287

FOREIGN PATENT DOCUMENTS 62-126524 6/1987 Japan .

*Primary Examiner*—Prince Willis
*Assistant Examiner*—Andrew L. Oltmans
*Attorney, Agent, or Firm*—Sughrue, Mion, Zinn, Macpeak & Seas, PLLC

[57] ABSTRACT

A method of blackening a magnetic shield for use in a color CRT (Cathode Ray Tube) is disclosed. A plurality of magnetic shield members are stacked with clamps inserted in their holes beforehand or with the intermediary of cut and raised portions or lugs thereof. Therefore, efficient work is promoted in relation to a blackening furnace and other facilities, work space, the number of steps of forming a blackening film, etc. In addition, oxygen flows evenly between the adjacent shield members, forming blackening films of high quality.

11 Claims, 4 Drawing Sheets

METHOD OF BLACKENING A MAGNETIC SHIELD FOR USE IN A COLOR CRT

BACKGROUND OF THE INVENTION

The present invention relates to a magnetic shield for use in a color CRT (Cathode Ray Tube) and, more particularly, to a method of forming a blackening film on the surface of a magnetic shield efficiently.

It is a common practice with a color CRT for television or display, particularly a color CRT including a shadow mask, to position a mask frame at the inside of a face panel and cause it to support the shadow mask. A magnetic shield is affixed to the mask frame by clamps or similar assembling members in order to protect an electron beam issuing from an electron gun from the influence of, e.g., terrestrial magnetism. Usually, a black oxide film ($Fe_3O_4$), or blackening film as referred to hereinafter, is formed on the surface of the magnetic shield in the same manner as blackening films formed on the mask frame and shadow mask. The blackening film of the magnetic shield serves to absorb or diffuse light and electron beam, to radiate heat , and to prevent metallic surfaces from forming rust during heat treatment. Some different blackening methods for forming such a blackening film have been proposed in the past. However, the conventional methods are low in working efficiency and in quality.

Technologies relating to the present invention are disclosed in, e.g., Japanese Patent Laid-Open Publication No. 62-126524.

SUMMARY OF THE INVENTION

It is therefore an object of the present invention to provide a blackening method capable of forming a blackening film on the surface of a magnetic shield efficiently while providing the film with high quality.

A method of blackening a magnetic shield for use in a color CRT of the present invention has the steps of stacking a plurality of magnetic shield members at preselected intervals, maintaining a preselected clearance between adjacent ones of the magnetic shield members by assembling members, and heating the magnetic shield members in an oxidizing atmosphere. As a result, a blackening film is formed on each of the magnetic shield members.

BRIEF DESCRIPTION OF THE DRAWINGS

The above and other objects, features and advantages of the present invention will become apparent from the following detailed description taken with the accompanying drawings in which.

In the drawings, identical reference numerals denote identical structural elements.

DESCRIPTION OF THE PREFERRED EMBODIMENTS

Figure 1:
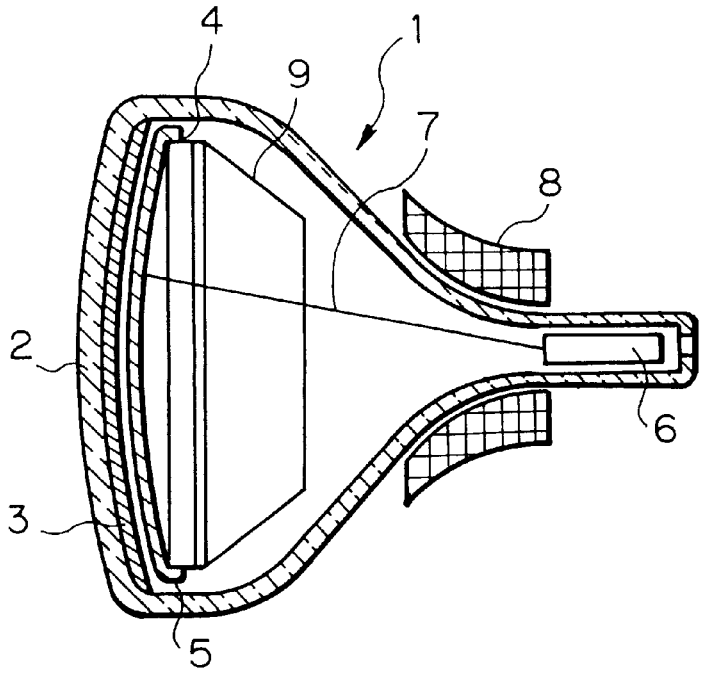
Fig. 1 PRIOR ART
FIG. 1 is a section showing a conventional color CRT.

To better understand the present invention, brief reference will be made to a conventional color CRT, shown in FIG. 1.

As shown, the CRT, generally 1, has a face panel 2 at its front end. A fluorescent surface 3 is formed on the inner surface of the face panel 2. A shadow mask 5 is disposed in the CRT 1 and mounted on a mask frame 4. A magnetic shield 9 is also mounted on the mask frame 4. An electron gun 6 is positioned in the neck portion of the CRT 1. A deflection yoke 8 surrounds the neck portion of the CRT 1. An electron beam 7 issuing from the electron gun 6 scans the fluorescent surface 3 of the shadow mask 5 while being deflected by a magnetic field formed by the deflection yoke 8. As a result, an image is displayed on the fluorescent surface 3. The magnetic shield 9 protects the electron beam 7 from the influence of, e.g., terrestrial magnetism.

Figure 2:
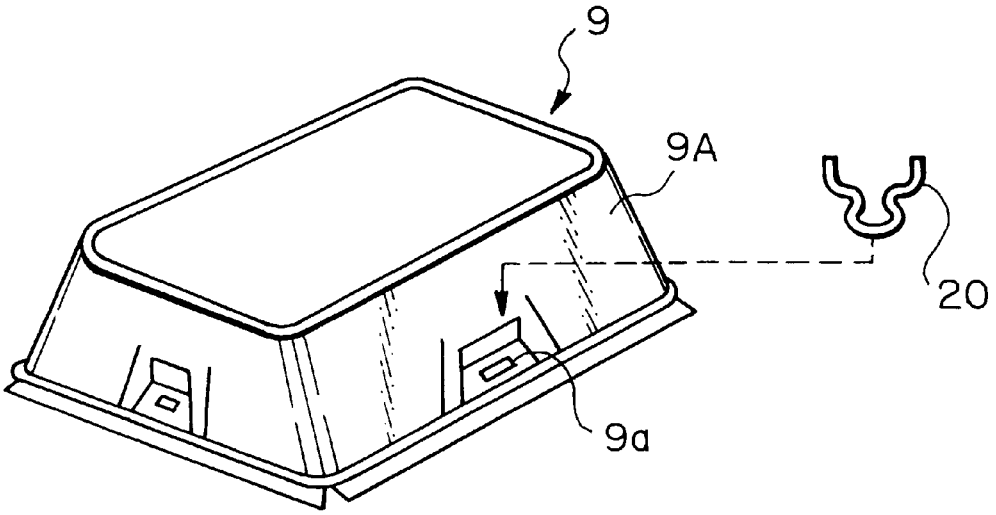
Fig. 2 PRIOR ART
FIG. 2 is an external perspective view of a magnetic shield included in the CRT.

As shown in FIG. 2, the magnetic shield 9 is usually formed with four to six holes 9*a* so as to be connected to the mask frame 4. After the magnetic shield 9 has been positioned on the mask frame 4, clamps 20 are respectively inserted in the above holes 9*a* in order to affix the shield 9 to the frame 4. A blackening film is formed on the shield 9 in the same manner as blackening films formed on the mask frame 4, shadow mask 5 and other metallic parts. The blackening film of the shield 9 serves to absorb or diffuse light and electron beam, to radiate heat, and to prevent metallic surfaces from forming rust during heat treatment.

Let the magnetic shield not subjected to the formation of the blackening film be referred to as a magnetic shield member, or simply shield member, 9A in distinction from the magnetic shield 9 formed with the blackening film.

Figure 3A:
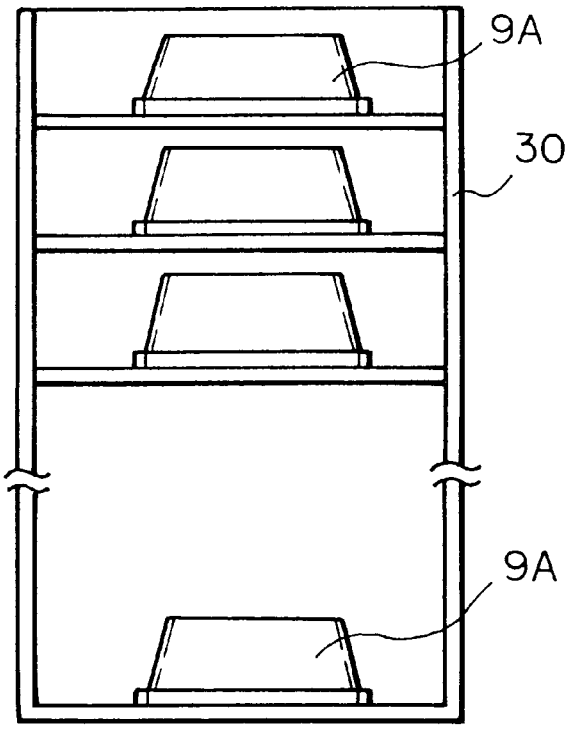
Fig. 3A PRIOR ART
FIGS. 3A and 3B each shows a particular conventional method of blackening the magnetic shield.
Figure 3B:
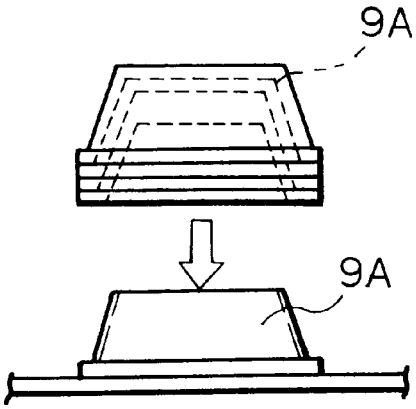
Fig. 3B PRIOR ART

FIGS. 3A and 3B each shows a particular condition in which the magnetic shield members 9A have customarily been stacked for the formation of the blackening films. In the condition of FIG. 3A, the shield members 9A are respectively positioned on consecutive shelves included in a stack cage 30. The stack cage 30 with the shield members 9A is placed in a blackening furnace and subjected to an oxidizing atmosphere at a temperature of about 500° C. to 600° C. As a result, the blackening film is formed on each shield member 9A. In the other condition shown in FIG. 3B, the shield members 9A are directly stacked together and then placed in a blackening furnace held in the above conditions.

However, the two conventional schemes for blackening the magnetic shield member 9A each has both merits and demerits, as follows. While the method of FIG. 3A using the stack cage 30 enhances the quality of the blackening film, it is not practicable without resorting to a large scale blackening furnace or a large number of blackening furnaces and a broad area for storage. The method of FIG. 3B directly stacking the magnetic shield members 9A promotes efficient operation. However, oxygen cannot flow smoothly or evenly between the adjacent shield members 9A. The resulting blackening films formed on the shield members 9A are irregular and low quality.

Preferred embodiments of the blackening method in accordance with the present invention will be described hereinafter.

Figure 4:
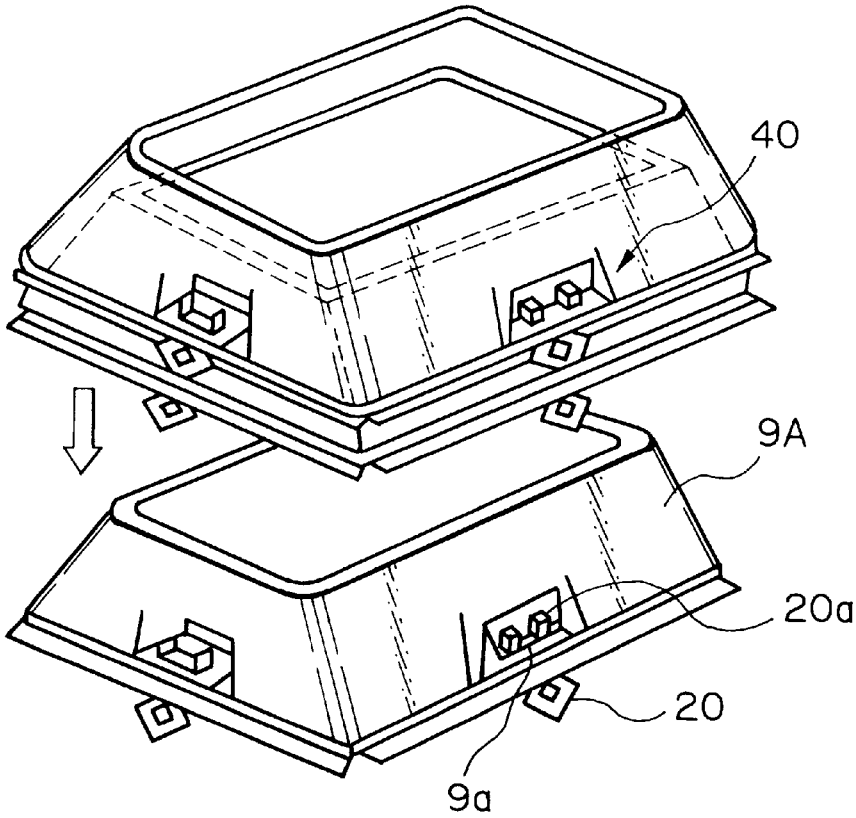
FIG. 4 is a perspective view showing magnetic fields stacked together by a blackening method embodying the present invention.
Figure 5:
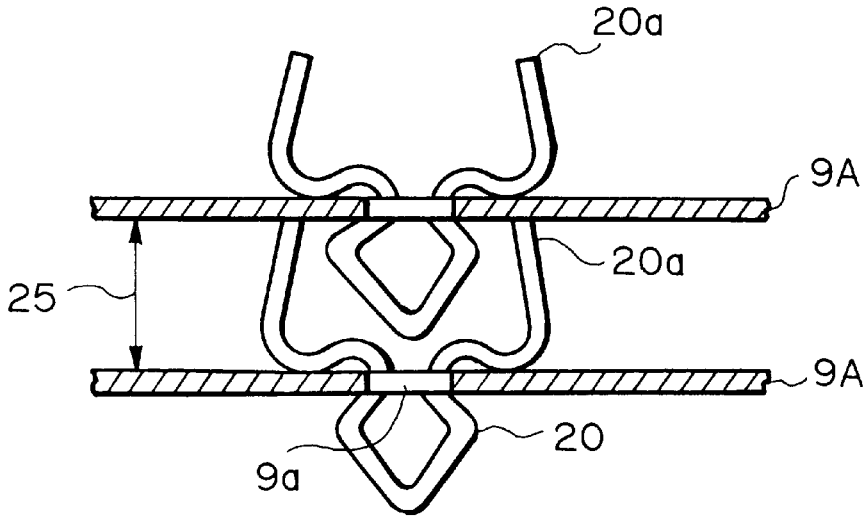
FIG. 5 is a fragmentary enlarged view of the stack shown in FIG. 4.

First, reference will be made to FIG. 4 for describing a method of affixing a mask frame and a magnetic shield by use of clamps, particularly how magnetic shield members are stacked by a blackening method embodying the present invention. There are shown in FIG. 4 magnetic shield members 9A to be blackened and clamps 20. Each shield member 9A is formed with four to six holes 9*a*. The clamps 20 are inserted in the holes 9*a* of each shield member 9A beforehand. The shield members 9A with the clamps 20 are sequentially stacked one upon the other. As a result, as shown in FIG. 5, the upper ends of the clamps 20 of the underlying shield member 9A play the role of positioning means for positioning the overlying shield member 9A while forming a clearance 25 between the two shield members 9A. In FIG. 4, the reference numeral 40 designates a stacking portion.

The shield members 9A stacked as stated above are placed in a blackening furnace. Then, blackening films are formed on the shield members 9A in an oxidizing atmosphere at a temperature of, e.g., about 500° C. to 600° C. At this instant, the clearance 25 between the adjacent shield members 9A allows oxygen to flow smoothly and evenly between the shield members 9A. Consequently, the metallic surface of each shield member 9A is uniformly oxidized, forming a blackening film of high quality. Because the clamps 20 are fitted on each shield member 9A beforehand, the shield member 9A can be easily attached to the mask frame 4, FIG. 1, without the clamps 20 being dropped inside of the face panel 2, FIG. 1; otherwise, the clamps 20 would damage the fluorescent surface. In addition, because the shield members 9A a r e stacked with the intermediary of the clamps 20, the space to be allocated to the blackening furnace and storage is saved.

It is to be noted that the the magnetic shield 9 and mask frame 4 may be connected together by any suitable retaining mechanism other than one using the clamps 20.

Figure 6:
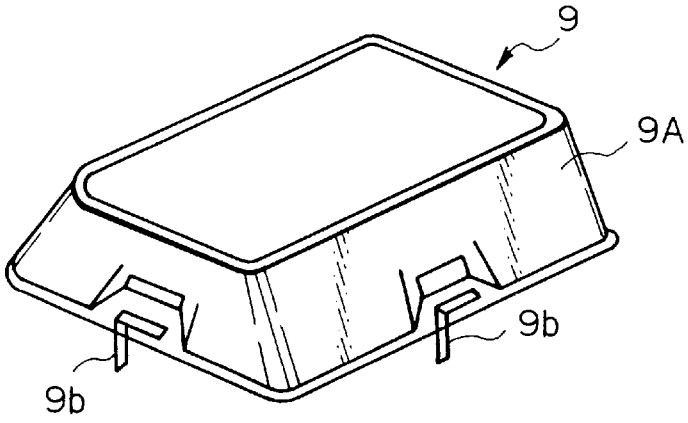
FIGS. 6, 7 and 8 each shows an alternative embodiment of the present invention.

FIG. 6 shows an alternative embodiment of the present invention. As shown, each shield member 9A is formed with lugs 9*b* constituting the retaining mechanism. When a desired number of shield members 9A are stacked, the lugs 9*b* form a clearance between the adjacent shield members 9A, although not shown specifically. This is also successful to cause oxygen to flow evenly between the adjacent shield members 9A, insuring blackening films of high quality.

Figure 7:
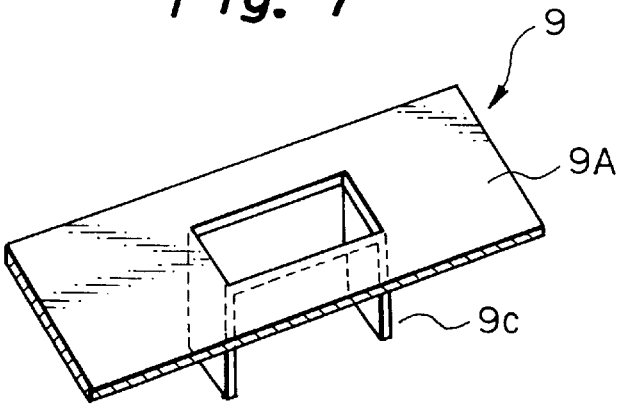

FIG. 7 shows another alternative embodiment of the present invention. As shown, lugs 9*c* protrude from both sides of each shield member 9A in order to further stabilize the connection between the shield member 9A and the mask frame 4, FIG. 1. In addition, the lugs 9*c* play the role of positioning means for allowing the shield members 9A to be stacked more stably while forming a clearance between them.

Figure 8:
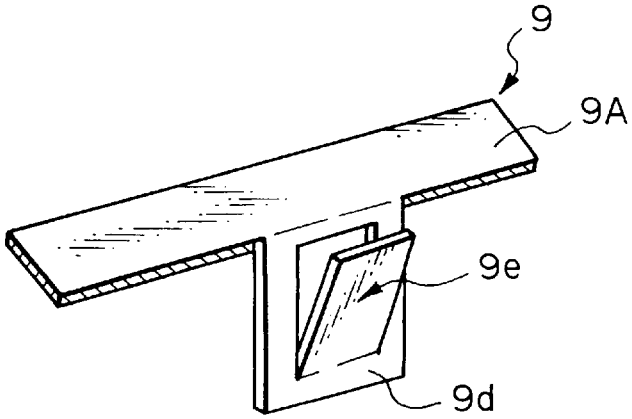

FIG. 8 shows a further alternative embodiment of the present invention. As shown, a tongue 9*d* with a stop 9*e* extends out from each shield member 9A in order to stabilize the connection between the shield member 9A and the mask frame 4, FIG. 1. At the same time, the tongue 9*d* plays the role of the positioning means for forming a clearance between the adjacent shield members 9A when the shield members 9A are stacked.

As stated above, the embodiments shown in FIGS. 6–8 each forms a clearance between the adjacent shield members 9A by use of conventional cut and raised portions or lugs.

In summary, in accordance with the present invention, a plurality of magnetic shield members are stacked with clamps inserted in their holes beforehand or with the intermediary of cut and raised portions or lugs thereof. Therefore, efficient work is promoted in relation to a blackening furnace and other facilities, work space, the number of steps of forming a blackening film, etc. In addition, oxygen flows evenly between the adjacent shield members, forming blackening films of high quality.

Various modifications will become possible for those skilled in the art after receiving the teachings of the present disclosure without departing from the scope thereof.

What is claimed is:

1. A method of blackening a magnetic shield for use in a color CRT, comprising the steps of:

(a) stacking a plurality of magnetic shield members at preselected intervals;

(b) maintaining a preselected clearance between adjacent ones of said plurality of magnetic shield members by assembling said plurality of magnetic shield members with a plurality of supporting members connected to each of said plurality of magnetic shield members; and (c) heating said plurality of magnetic shield members in an oxidizing atmosphere, whereby a blackening film is formed on each of said plurality of magnetic shield members.

2. A method as claimed in claim 1, wherein said plurality of said supporting members comprise clamps for connecting the individual magnetic shield member to a mask frame disposed in the CRT.

3. A method as claimed in claim 1, wherein said plurality of said supporting members comprise lugs protruding from the individual magnetic shield member.

4. A method as claimed in claim 3, wherein said lugs are formed by cutting and bending said lugs from the individual magnetic shield member.

5. A method as claimed in claim 3, wherein said lugs each includes a stop.

6. A method of blackening a magnetic shield for use in a color CRT, comprising the steps of (a) stacking a plurality of magnetic shield members at preselected intervals;

(b) maintaining a preselected clearance between adjacent ones of said plurality of magnetic shield members by assembling said plurality of magnetic shield members with a plurality of clamps; and (c) heating said plurality of magnetic shield members in an oxidizing atmosphere, whereby a blackening film is formed on each of said plurality of magnetic shield members.

7. A method as claimed in claim 6, wherein said plurality of clamps connect the individual magnetic shield member to a mask frame disposed in the CRT.

8. A method of blackening a magnetic shield for use in a color CRT, comprising the steps of:

(a) stacking a plurality of magnetic shield members at preselected intervals;

(b) maintaining a preselected clearance between adjacent ones of said plurality of magnetic shield members by assembling said plurality of magnetic shield members with a plurality of lugs; and (c) heating said plurality of magnetic shield members in an oxidizing atmosphere, whereby a blackening film is formed on each of said plurality of magnetic shield members.

9. A method as claimed in claim 8, wherein said plurality of lugs protrude from the individual magnetic shield member.

10. A method as claimed in claim 9, wherein said plurality of lugs are formed by cutting and bending said lugs from the individual magnetic shield member.

11. A method as claimed in claim 9, wherein said plurality of lugs each includes a stop.

* * * * *